US006828953B2

(12) United States Patent
Hoshino

(10) Patent No.: US 6,828,953 B2
(45) Date of Patent: Dec. 7, 2004

(54) METHOD OF DRIVING LIQUID CRYSTAL DISPLAY PANEL

(75) Inventor: Masafumi Hoshino, Chiba (JP)

(73) Assignee: Seiko Instruments Inc., Chiba (JP)

( * ) Notice: Subject to any disclaimer, the term of this patent is extended or adjusted under 35 U.S.C. 154(b) by 188 days.

(21) Appl. No.: 09/998,971

(22) Filed: Oct. 31, 2001

(65) Prior Publication Data

US 2002/0075217 A1 Jun. 20, 2002

(30) Foreign Application Priority Data

Nov. 2, 2000 (JP) ..... 2000-336207

(51) Int. Cl.[7] ..... G09G 3/36; G09G 5/00

(52) U.S. Cl. ..... 345/100; 345/89; 345/96; 345/209

(58) Field of Search ..... 345/87–90, 93–96, 345/97–100, 690, 208–209

(56) References Cited

U.S. PATENT DOCUMENTS 6,057,824 A * 5/2000 Katakura et al. ..... 345/100

* cited by examiner

*Primary Examiner*—Regina Liang
*Assistant Examiner*—Duc Q Dinh
(74) *Attorney, Agent, or Firm*—Adams & Wilks

(57) ABSTRACT

In a method of driving multiple gradation display of a liquid crystal display panel for driving a simple matrix type liquid crystal display panel holding a liquid crystal layer between a row electrode group and column electrode group and providing pixels in matrix in accordance with given pixel data, to reduce power consumption of a simple matrix type liquid crystal display panel by restraining the amount of change in the waveform without deteriorating display quality, frame modulation is carried out at respective row and when rows are made ON and OFF alternately each row at an intermediate gradation level, every other row is selected. In the case of driving by nondistributed type 4MLA method of the invention constituted in this way, a change in a waveform of a column electrode is carried out twice per frame. The number of changes is significantly reduced in comparison the number of changes in driving by conventional nondistributed type 4 MLA method (N times).

19 Claims, 7 Drawing Sheets

WAVEFORM OF VOLTAGE AVERAGING METHOD OR SA METHOD DRIVE (HATCHED PORTION DESIGNATES COLUMN ELECTRODE WAVEFORM)
(THE INVENTION)

WAVEFORM OF NONDISTRIBUTED TYPE 4MLA METHOD DRIVE (HATCHED PORTION DESIGNATES COLUMN ELECTRODE WAVEFORM)
(THE INVENTION)

FRAME

| GRADATION LEVEL | | 1 | | 2 | | 3 | | 4 | |
|---|---|---|---|---|---|---|---|---|---|
| | | ODD | EVEN | ODD | EVEN | ODD | EVEN | ODD | EVEN |
| 0 | 2n+1 | 0 | 0 | 0 | 0 | 0 | 0 | 0 | 0 |
| | 2n+2 | 0 | 0 | 0 | 0 | 0 | 0 | 0 | 0 |
| 1 | 2n+1 | 1 | 0 | 0 | 1 | 0 | 0 | 0 | 0 |
| | 2n+2 | 0 | 0 | 0 | 0 | 1 | 0 | 0 | 1 |
| 2 | 2n+1 | 1 | 0 | 0 | 1 | 1 | 0 | 1 | 0 |
| | 2n+2 | 0 | 1 | 1 | 0 | 0 | 1 | 0 | 1 |
| 3 | 2n+1 | 0 | 1 | 1 | 0 | 1 | 1 | 1 | 1 |
| | 2n+2 | 1 | 1 | 1 | 1 | 0 | 1 | 1 | 0 |
| 4 | 2n+1 | 1 | 1 | 1 | 1 | 1 | 1 | 1 | 1 |
| | 2n+2 | 1 | 1 | 1 | 1 | 1 | 1 | 1 | 1 |

FRAME MODULATION PATTERN (5 GRADATIONS)
N ROW PANEL n : 0 ~ N / 2

FIG.2

| | | | | |
|---|---|---|---|---|
| 1 | +1 | −1 | −1 | −1 |
| 2 | −1 | +1 | −1 | −1 |
| 3 | −1 | −1 | +1 | −1 |
| 4 | −1 | −1 | −1 | +1 |

ORTHOGONAL FUNCTION(4MLA)

FIG.3

WAVEFORM OF VOLTAGE AVERAGING METHOD OR SA METHOD DRIVE (HATCHED PORTION DESIGNATES COLUMN ELECTRODE WAVEFORM)
(THE INVENTION)

WAVEFORM OF VOLTAGE AVERAGING METHOD OR SA METHOD DRIVE (HATCHED PORTION DESIGNATES COLUMN ELECTRODE WAVEFORM)
(CONVENTIONAL EXAMPLE)

WHEN CONTIGUOUS COLUMN ELECTRODES ARE BOTH ON OR BOTH OFF

WHEN ONE OF THE CONTIGUOUS COLUMN ELECTRODES IS ON AND THE OTHER IS OFF

WAVEFORM OF NONDISTRIBUTED TYPE 4MLA METHOD DRIVE (HATCHED PORTION DESIGNATES COLUMN ELECTRODE WAVEFORM)
(THE INVENTION)

WHEN CONTIGUOUS COLUMN ELECTRODES ARE BOTH ON OR BOTH OFF

WHEN ONE OF THE CONTIGUOUS COLUMN ELECTRODES IS ON AND THE OTHER IS OFF

WAVEFORM OF NONDISTRIBUTED TYPE 4MLA METHOD DRIVE (HATCHED PORTION DESIGNATES COLUMN ELECTRODE WAVEFORM)
(CONVENTIONAL EXAMPLE)

METHOD OF DRIVING LIQUID CRYSTAL DISPLAY PANEL

BACKGROUND OF THE INVENTION

1. Field of the Invention

The present invention relates generally to a method of driving a simple matrix type liquid crystal display panel using STN liquid crystals or the like and, more particularly, to a method of driving a liquid crystal display panel of low power consumption suitable for intermediate tone display by frame modulation.

2. Description of the Related Art

A simple matrix type liquid crystal panel is constructed by maintaining a liquid crystal layer between a row electrode group and a column electrode group to define a plurality of pixels in matrix form. Further, as methods for driving the simple matrix type liquid crystal display panel, there are the voltage averaging method, the SA method and the MLA method.

The voltage averaging method is a method of driving a simple matrix type liquid crystal display panel for successively selecting respective row electrodes one by one and providing all the column electrodes with data signals in correspondence with ON/OFF states in accordance with selected timings. Therefore, the voltage applied to respective electrodes becomes high only once in one frame cycle T for selecting all the row electrodes and becomes a constant bias voltage during a remaining nonselection time period. According to the voltage averaging method, when the response speed of the liquid crystal material used is slow, there is provided a change in brightness in accordance with the effective value of the waveform of the applied voltage in the one frame cycle to thereby maintain the most suitable contrast for the conditions. However, when the division number is increased and frame frequency is reduced, the difference between frame cycle time and response time of liquid crystal is reduced, the liquid crystal responds separately to each applied pulse, a flicker in brightness referred to as a frame response phenomenon becomes apparent, and the contrast is reduced.

The SA (Smart Addressing) method is another method for driving a simple matrix type liquid crystal display panel. In either the voltage averaging method or the SA method, the respective row electrodes are successively selected one at a time and data signals in correspondence with ON/OFF states are provided to all the column electrodes in conformity with selected timings. However, common nonselection levels of contiguous frames are different from each other in the former and the same in the latter.

The MLA method is also referred to as the multiple line addressing or multiple line selecting method for simultaneously selecting a plurality of row electrodes so that apparent high frequency formation is achieved and the frame response phenomenon which is problematic in the voltage averaging method is restrained. A unique scheme is adopted in the MLA method in order to simultaneously select a plurality of row electrodes and display respective pixels independently from each other. In this scheme there is carried out set successive scanning involving applying a plurality of row signals represented by a set of orthogonal functions to a row electrode group according to a set order for each respective selection time, there is successively carried out a cross-products operation between the set of orthogonal functions and a set of selected pixel data, and column signals having voltage levels in accordance with the result of the cross-products operation are applied to a column electrode group during the selection time in synchronism with the successive scanning of the set.

Further, the MLA method is disclosed in Japanese Patent Laid Open No. 100642/1993, Japanese Patent Laid-Open No. 27907/1994, Japanese Patent Laid-Open No. 72454/1995, Japanese Patent Laid-Open No. 193679/1995, Japanese Patent Laid-Open No. 199863/1995, Japanese Patent Laid-Open No. 311564/1995, Japanese Patent Laid-Open No. 184807/1996, Japanese Patent Laid-Open No. 184808/1996, Japanese Patent Laid-Open No. 2000-19482 and so on.

Next, as multiple gradation display methods of a simple matrix type liquid crystal display panel, there are generally provided a pulse width modulating system and a frame modulating system, with the latter established as an inexpensive, technologically sound method. The frame modulating system is a system in which two gradations of ON/OFF are selectively chosen over a plurality of frames to thereby provide two or more gradations utilizing temporal average values. Further, the intermediate tone display of the simple matrix type liquid crystal display panel is realized by a combination of the driving method and the multiple gradation display method.

Here, an investigation will be given of power consumption of a simple matrix type liquid crystal display panel with the frame modulating system as the multiple gradation display method, comparing when the panel is driven respectively by the voltage averaging method, the SA method and the MLA method. Further, the frame modulation is carried out by either one row at a time or one pixel at a time.

FIG. 2 shows an example of a 5 gradation frame modulation pattern applied to a simple matrix type liquid crystal display panel. In FIG. 2, at gradation level 0, all values of intersections of rows and columns of the simple matrix type liquid crystal display panel are represented by 0 (OFF) from the 1-st frame to the 4-th frame. Here, the simple matrix type liquid crystal display panel is provided with a matrix of N rows×M columns.

At gradation level 1, 1 (ON) is given to pixels at intersections of (2n+1)-th row and odd number columns of the 1st frame, intersections of (2n+1)-th row and even number columns of the 2nd frame, intersections of (2n+2)-th row and odd number columns of the 3rd frame and intersections of (2n+2)-th row and even number columns of the 4th frame and 0 (OFF) is given to other pixels in the simple matrix type liquid crystal display panel. Here, notation n designates an integer of 0 through N/2. Therefore, notation (2n+1) throw represents an odd number row and notation (2n+2)-th row represents an even number row contiguous thereto.

At gradation level 2, 1 (ON) is given to pixels at intersections of the (2n+1)-th row and odd number rows of the 1st frame, intersections of the (2n+2)-th row and even number columns of the 1st frame, intersections of the (2n+1)-th row and even number columns of the 2nd frame, intersections of the (2n+1)-th row and odd number columns of the 3rd frame, intersections of (2n+2)-th row and even number columns of the 3rd frame, intersections of the (2n+1)-th row and odd number columns of the 4th frame and intersections of the (2n+2)-th row and even number columns of 4-th frame, and 0 (OFF) is given to other pixels of the simple matrix type liquid crystal display panel.

At gradation level 3, 0 (OFF) is given to pixels at intersections of the (2n+1)-th row and odd number columns of the 1st frame, intersections of the (2n+1)-throw and even number columns of the 2nd frame, intersections of the (2n+2)-th row and odd number columns of the 3rd frame and intersections of the (2n+2)-th row and even number columns of the 4th frame, and 1 (ON) is given to other pixels in the simple matrix type liquid crystal display panel.

At gradation level 4, 1 (ON) is given to all of the pixels at intersections of rows and columns of the simple matrix type liquid crystal display panel from 1-th frame to 4-th frame.

First, FIGS. 5A and 5B show column electrode waveforms when multiple gradation display is carried out by applying the frame modulating system based on the 5 gradation frame modulation pattern of FIG. 2 to the simple matrix type liquid crystal display panel driven by the voltage averaging method or the SA method and when scanning is carried out from an upper portion to a lower portion of a screen. However, for simplifying the explanation, display data is data of one color of intermediate tone.

That is, FIG. 5A shows a column electrode waveform when the pixels of the intersections of a certain column's electrodes with those of the (2n+1)-th row and of the (2n+2)-th row for any applicable n are both ON or both OFF in the 5 gradation frame modulation pattern of FIG. 2, this waveform being indicated by hatched lines. The level of the column electrode waveform in this case is $+1\sqrt{N}$ in selection time t in one frame period T and $-1\sqrt{N}$ in remaining nonselection time (T−t). At the next frame, the level is inverted and there is a similar column voltage waveform. Therefore, when both upper and lower rows are made ON or OFF at an intermediate gradation level, the number of changes of the column electrode waveform in one frame is 1.

Further, FIG. 5B shows a column electrode waveform when one of pixels at respective intersections of a certain column electrode and the (2n+1)-th row electrode and the (2n+2)-th row electrode for any applicable n is made ON and other is made OFF in the 5 gradation frame modulation pattern of FIG. 2, this waveform indicated by hatched lines. The level of the column electrode waveform in this case is $+1\sqrt{N}$ in selecting time t of one frame period T. In the remaining nonselection time (T−t), at the initial t-length period the level is $-1\sqrt{N}$, at the next t-length period the level is $+1\sqrt{N}$ and so on thereafter, the level is similarly changed until the final t. At successive frames, the level is inverted and a similar column voltage waveform is shown. Therefore, when the pixel is made ON and OFF at every other row at the intermediate gradation level, the number of changes of the column electrode waveform in one frame is N, the same as the number of row electrodes.

Next, FIGS. 7A and 7B show column electrode waveforms when multiple gradation display is carried out by applying the frame modulation system based on the 5 gradation frame modulation pattern of FIG. 2 to the simple matrix type liquid crystal display panel driven by the MLA method and when scanning is carried out successively from an upper portion to a lower portion of a screen. Further, for simplifying the explanation, displayed data is data of one color of intermediate tone.

Meanwhile, there are a nondistributed type and a distributed type in the MLA driving method. According to the nondistributed type MLA driving method, row function voltage given by an orthogonal function table is applied to a plurality of row electrodes simultaneously selected, and not applied evenly throughout one frame period. In contrast thereto, according to the distributed type MLA driving method, row function voltage given by an orthogonal function table is applied to a plurality of row electrodes simultaneously selected and applied evenly throughout one frame period.

Explaining the nondistributed type MLA driving method in reference to an orthogonal function table of FIG. 3, in first selection time t, voltages 1, −1, −1, and −1 (relative values) are respectively applied to four electrodes of the (2n+1)-th row, the (2n+2)-th row, the (2n+3)-th row and the (2n+4)-th row. The same four row electrodes are applied with voltages −1, 1, −1 and −1 at the second selection time t, voltages −1, −1, 1 and −1 at third selection time t and voltages −1, −1, −1 and 1 at successive fourth selection time t, respectively, In this way, the row function voltages given by the orthogonal function table are applied to the plurality of row electrodes simultaneously selected without being distributed. Therefore, in the case of the nondistributed type MLA method, for simultaneously selecting four voltages by using the orthogonal function table of FIG. 3, selection time is 4t and nonselection time is (T−4t).

FIG. 7A shows a column electrode waveform when the two pixels at the intersections of a certain column electrode and the (2n+1)-th row electrode and the (2n+2)-th row electrode for any applicable n are made both ON or both OFF, this waveform indicated by hatched lines. In selection time 4t of one frame period T the level of the column electrode waveform in this case is $+2\sqrt{N}$ at initial t, $-2\sqrt{N}$ at the next 3t and $-2\sqrt{N}$ at remaining nonselection time (T−4t). The level is inverted at a successive frame and similar column voltage waveform is shown. Therefore, when both of upper and lower rows are made ON or OFF at intermediate gradation level, a number of changes of the column electrode waveform in one frame is 1.

FIG. 7B shows a column electrode waveform when one of the pixels at respective intersections of a certain column electrode and the (2n+1)-th row electrode and the (2n+2)-th row electrode is made ON and other is made OFF in the 5 gradation frame modulation pattern of FIG. 2, this waveform indicated by hatched lines. In selection time 4t of one frame period T, the level of the column electrode waveform in this case is $+2\sqrt{N}$ at initial t, and $-2\sqrt{N}$ at the next 3t. In remaining nonselecting time (T−4t), the level is $-2\sqrt{N}$ at initial 4t, $+2\sqrt{N}$ at the next 4t and thereafter, the level is similarly changed repeatedly until final 4t. At the next frame, the level is inverted and similar column voltage waveform is shown. Therefore, when the column is made ON and OFF at every other piece at an intermediate gradation level, the number of changes of the column electrode waveform in one frame is N/8.

Further, even when the panel is driven by the distributed type MLA method, the number of changes of the column electrode waveform in one frame is 1 when both upper and lower columns are made ON or OFF at intermediate gradation level and N/8 when the column voltage is changed between ON and OFF at every other electrode at intermediate gradation level.

Meanwhile, power consumption of a liquid crystal panel is determined by free discharge current between row electrodes and column electrodes. In other words, power consumption of a liquid crystal panel is determined by values of voltages between row electrodes and column electrodes and waveform (amount of change).

However, in the simple matrix type liquid crystal panel for carrying out multiple gradation display by the frame modulating system, when the panel is respectively driven by the voltage average method, the SA method or the MLA method and the screen is scanned successively from the upper portion to the lower portion, the column electrode waveform is changed a large number of times, N times in the case of FIG. 5B or N/8 times in the case of FIG. 7B in one frame.

That is, according to the conventional scanning system of scanning successively the screen from the upper portion to the lower portion, in the simple matrix type liquid crystal panel driven by the voltage averaging method, the SA method or the MLA method and carrying out the multiple gradation display applied with the frame modulating system, there poses a problem that there is power consumption due to the large number of changes of the column electrode waveform produced in one frame.

The problem to be resolved resides in reducing power consumption of a simple matrix type liquid crystal panel by restraining a number of changes in a waveform between a row electrode and a column electrode without deteriorating display quality.

SUMMARY OF THE INVENTION

In order to resolve the above-described problem, the invention is constituted by paying attention to the fact that according to a screen display of a simple matrix type liquid crystal panel driven by voltage averaging method, SA method or MLA method, gradation is not frequently and significantly changed by background color or commonly used display data.

That is, according to a first aspect of the invention, there is provided a method of driving a liquid crystal display panel holding a liquid crystal layer between a row electrode group and a column electrode group in accordance with given pixel data, wherein frame modulation is used as a gradation system and the order of scanning the row electrode group is selected discontinuously in conformity with the frame modulation pattern of background color or commonly used display data such that the change in a waveform of the column electrode group is minimized.

Further, according to a second aspect of the invention, there is provided the method of driving a liquid crystal display panel according to the first aspect wherein when the frame modulation is carried out at every row and rows are made ON and OFF alternately each electrode thereof at an intermediate gradation level, every other row thereof is selected.

Further, according to a third aspect of the invention, there is provided the method of driving a liquid crystal display panel according to the first aspect wherein when the frame modulation is carried out at each pixel and pixels are made ON and OFF alternately each pixel in the column direction and in the row direction at an intermediate gradation level thereof, every other pixel in each direction is selected.

BRIEF DESCRIPTION OF THE DRAWINGS

FIG. 2 is a diagram showing an example of a frame modulation pattern of 5 gradations;

FIG. 3 is a diagram showing an example of an orthogonal function table used in 4MLA method;

DETAILED DESCRIPTION OF THE PREFERRED EMBODIMENTS

Figure 4A:
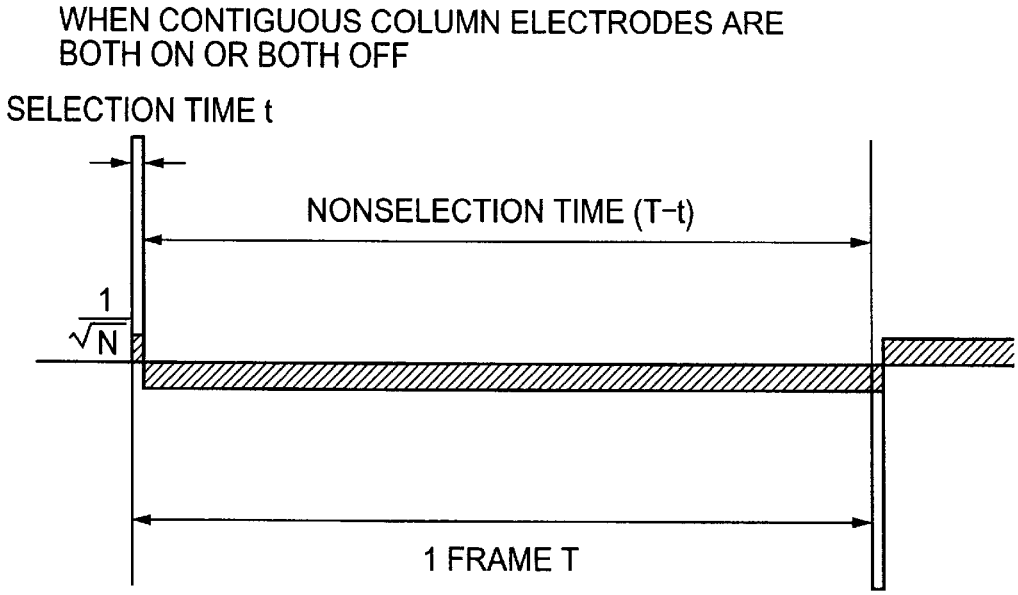
FIGS. 4A and 4B are waveform diagrams of driving by voltage averaging method or SA method according to the invention.
Figure 4B:
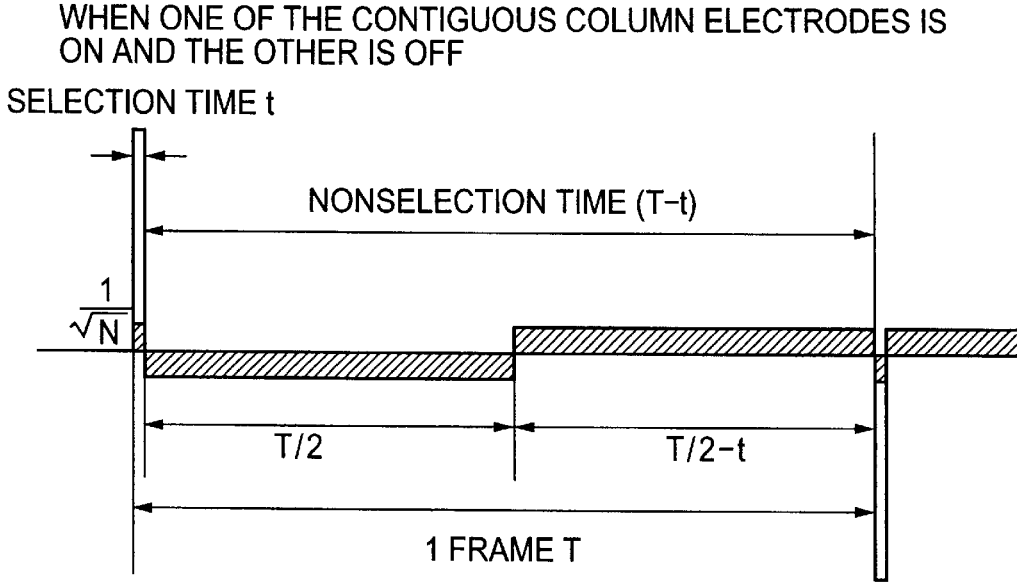

First, FIGS. 4A and 4B show column electrode waveforms when multiple gradation display is carried out by applying a frame modulating system of 5 gradation frame modulation pattern of FIG. 2 to a simple matrix type liquid crystal display panel driven by voltage averaging method or SA method and when a discontinuous scanning system according to the invention is applied. However, to simplify explanation, displayed data is data of one color of intermediate tone.

That is, FIG. 4A shows a column electrode waveform when both pixels at respective intersections of a certain column electrode and the (2n+1)-th row electrode and the (2n+2)-th row electrode are made ON or OFF in the 5 gradation frame modulation pattern of FIG. 2, this waveform indicated by hatched lines. The level of the column electrode waveform in this case is $+1\sqrt{N}$ in selection time t of one frame period T and $-1\sqrt{N}$ in remaining nonselection time (T−t). The level is inverted at successive frames with a similar column voltage waveform.

Therefore, when adjacent rows are all made ON or OFF at an intermediate gradation level, a number of changes in the column electrode waveform in one frame is 1. In sum, the number of changes in the column electrode waveform in one frame stays the same in the conventional scanning system in which scanning is carried out successively from an upper portion to a lower portion of a screen shown in FIG. 4A and in the scanning system according to the invention by discontinuous selection.

In contrast thereto, FIG. 4B shows a column electrode waveform provided by applying an embodiment of the invention to a case of a pattern in the bold frame of FIG. 2. That is, FIG. 4B shows a column electrode waveform according to an embodiment of the invention when one of the pixels at respective intersections of a certain column electrode and the (2n+1)-th row electrode and the (2n+2)-th row electrode is made ON and other is made OFF in the 5 gradation frame modulation pattern of FIG. 2.

In scanning operation of this case according to the invention, N row electrodes are divided into an odd number (2n+1)-th electrode group and an even number row electrode group. First, the odd number row electrode group is successively scanned, next, the even number row electrode group is successively scanned. Scanning is successively carried out in the case of the odd number electrode group of the 1st row, 3rd row, 5th row, 7th row, . . . in the case of the even number row electrode group, 2nd row, 4th row, 6th row, 8th row . . . The order of scanning of the row electrode groups can be carried out from the lower portion to the upper portion of the screen but also can be carried out in other orders.

By applying the scanning system by discontinuous selection of the embodiment, the level of the column electrode waveform in FIG. 4B is $+1\sqrt{N}$ in selection time t of one frame period T. In remaining nonselection time (T−t), the level is $-1\sqrt{N}$ at initial T/2 and $+1\sqrt{N}$ in the next (T−2t)/2. At successive frames the level is inverted and similar column voltage waveform is shown. In this way, in one frame period T, the level of the column electrode voltage is changed twice in all, once from $+2\sqrt{N}$ to $-2\sqrt{N}$ and once from $-2\sqrt{N}$ to $+2\sqrt{N}$.

Figure 5A:
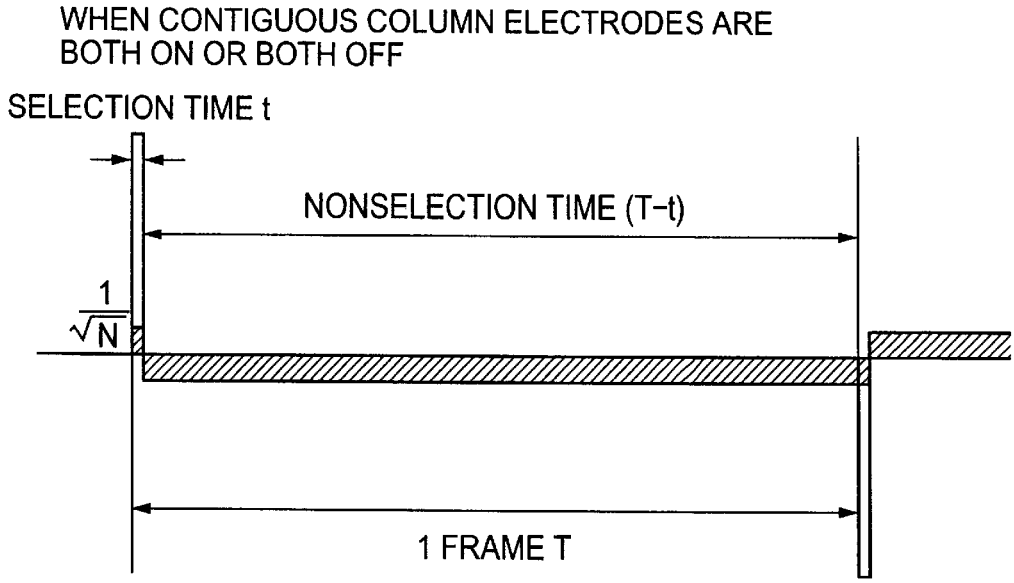
FIGS. 5A and 5B are waveform diagrams of driving by conventional voltage averaging method or SA method.
Figure 5B:
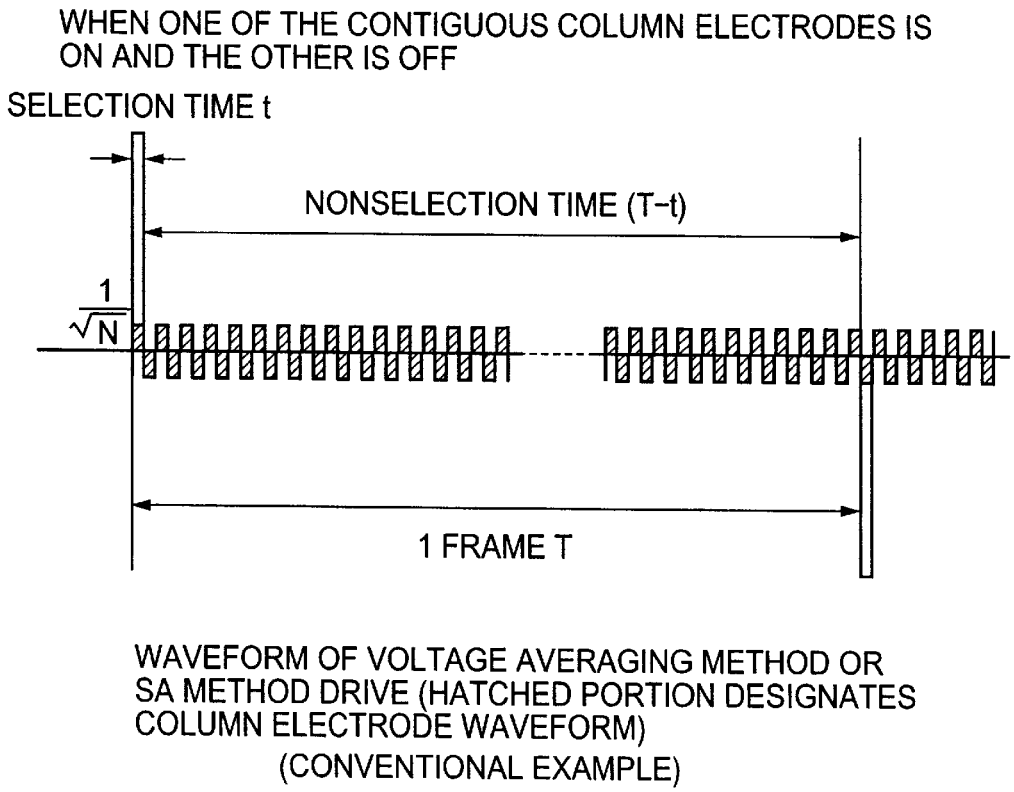

Therefore, when rows are made ON and OFF alternately every row at an intermediate gradation level, the number of changes in the column electrode waveform in one frame in the case of applying the scanning system by discontinuous selection according to the invention, is considerably reduced in comparison with N times in the case of the conventional scanning system successively scanning from the upper portion to the lower portion of the screen shown in FIG. 5B.

Figure 6A:
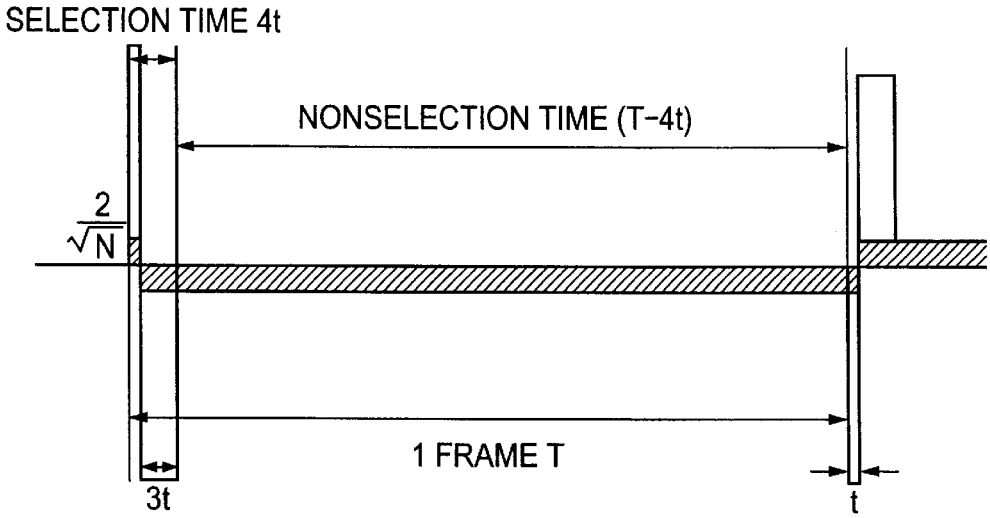
FIGS. 6A and 6B are waveform diagrams of driving by MLA method according to the invention.
Figure 6B:
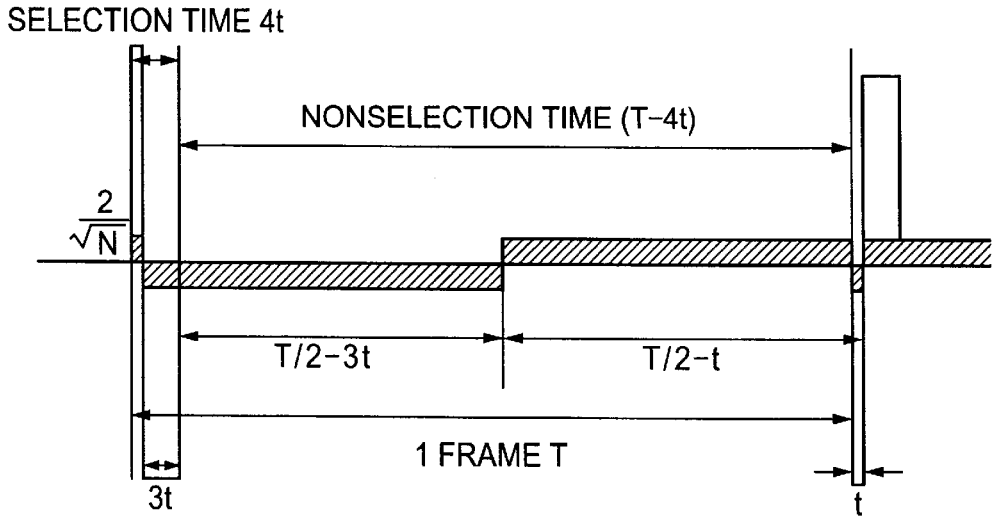

Next, FIGS. 6A and 6B show column electrode waveforms when there is carried out multiple gradation display applying the frame modulation system of the 5 gradation frame modulation pattern of FIG. 2 to a simple matrix type liquid crystal display panel driven by MLA method of a nondistributed type and when the discontinuous scanning system according to the invention is applied. However, to simplify the explanation, displayed data is data of one color of intermediate tone.

That is, FIG. 6A shows column electrode waveforms when the two pixels at the intersections of a certain column electrode and the (2n+1)-th row electrode and the (2n+2)-th row electrode are turned ON or OFF in the 5 gradation frame modulation pattern of FIG. 2, this waveform indicated by hatched lines.

The scanning operation according to the invention in this case is carried out by dividing N row electrodes into an odd number (2n+1)-th row electrode group and an even number (2n+2)-th row electrode group. For example, in the case of driving by 4 MLA method, first, 4 electrodes of the odd number row electrode group, starting with the 1st row, 3rd row, 5th row, and 7th row, are simultaneously selected; next, the 4 electrodes of the 9th row, 11th row, 13th row, and 15th row are simultaneously selected, thereafter, 4 pieces thereof are similarly selected simultaneously 4 at a time until (N−1) rows are selected and then these sets of 4 row electrode groups are all scanned successively from above. Next, 4 pieces of the even number row electrode group, starting from above with the 2nd row, 4th row, 6th row, and 8th row, are simultaneously selected; next, the 10-th row, 12-th row, 14-th row, and 16-th row are simultaneously selected; and thereafter, 4 electrodes thereof are similarly selected simultaneously until the N-th row is selected and then these sets of 4 row electrodes are scanned successively from above.

As has already been described, in the case of driving by the conventional 4MLA method, odd number rows and even number rows are not divided so that the first set simultaneously selected is the 1st row, 2nd row, 3rd row, and 4th row; next, the 5-th row, 6-th row, 7-th row, 8-th row are simultaneously selected; and thereafter, groups of four are similarly selected simultaneously until the N-th row is selected and then these sets of 4 row electrode groups are scanned successively from above. In contrast thereto, in the case of driving by 4MLA method according to the invention, there is provided the scanning system by discontinuous row electrode selection in which odd number rows and even number rows are grouped and these sets of 4 column electrodes are scanned successively from above or successively from below.

As shown by FIG. 6A, the level of the column electrode waveform in the case of driving by 4 MLA method according to the invention, described above, is $+2\sqrt{N}$ at initial t of selection time 4t of one frame period T, $-2\sqrt{N}$ in successive 3t and $2\sqrt{N}$ in remaining nonselection time (T−4t). At successive frames, the level is inverted with a similar column voltage waveform.

Figure 7A:
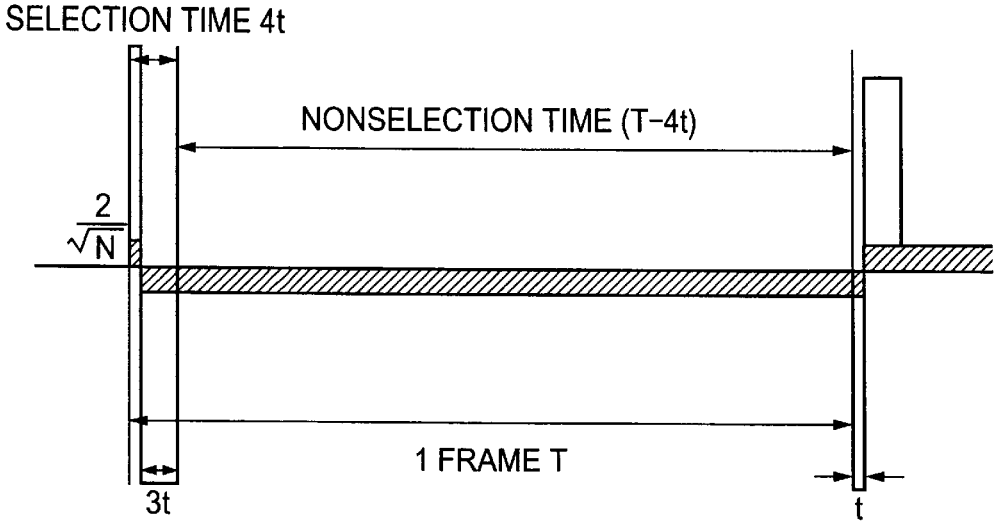
FIGS. 7A and 7B are waveform diagrams of driving by conventional MLA method.

Therefore, when adjacent rows are all made ON or OFF at an intermediate gradation level, the number of changes in the column electrode waveform in one frame is 1. In sum, the number of changes in the column electrode waveform in one frame in this case stays the same in the conventional scanning system scanning from the upper portion to the lower portion of the screen shown in FIG. 7A and in the scanning system by discontinuous selection according to the invention.

In contrast thereto, FIG. 6B shows a column electrode waveform provided by applying an embodiment of the invention to the case of the pattern in the bold frame of FIG. 2. That is, FIG. 6B shows the column electrode waveform according to the embodiment of the invention when one of the pixels at respective intersections of a certain column electrode with the (2n+1)-th row electrode and the (2n+2) th row electrode is made ON and other is made OFF in the 5 gradation frame modulation pattern of FIG. 2.

The level of the column electrode waveform in this case is $+2\sqrt{N}$ at the initial t of selection time 4t of one frame period T and $-2\sqrt{N}$ in the successive 3t. In the remaining nonselection time (T−4t), the level is $-2\sqrt{N}$ at initial (T/2−3t) and $+2\sqrt{N}$ at successive (T−2)/2. In this way, in one frame period T, the level of the column electrode voltage is changed twice in all, once from $+2\sqrt{N}$ to $-2\sqrt{N}$ and once from $-2\sqrt{N}$ to $+2\sqrt{N}$.

Figure 7B:
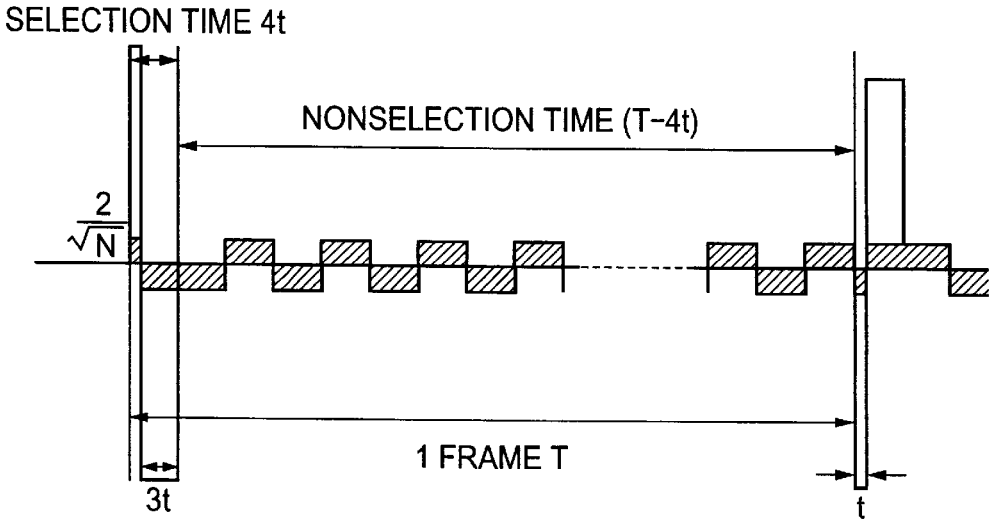

Therefore, when rows are made ON and OFF alternately with each row at an intermediate gradation level, the number of changes in the column electrode waveform in one frame is significantly reduced when the scanning system by discontinuous selection according to the invention is applied in comparison with the N/8 changes in the case of the conventional scanning system scanning from the upper portion to the lower portion of the screen as shown by FIG. 7B.

As described above, with regard to the method of driving a liquid crystal display panel according to the invention using frame modulation as gradation system for discontinuously selecting the order of scanning the row electrode groups in conformity with background color or frame modulation pattern of display data commonly used, to minimize the change in the waveform of the column electrode groups, a specific explanation has been given of the method of using the 5 gradation frame modulation pattern of FIG. 2 as the frame modulation pattern and discontinuously selecting the order to minimize the change in the waveform of the column electrode group by dividing the column electrode group into odd number rows and even number rows and selecting row by row in the voltage averaging method and SA method and simultaneously selecting predetermined numbers of rows in the MLA method. However, the frame modulation pattern and the method of discontinuously selecting the order to minimize the change in the waveform of the column electrode group, are not naturally limited thereto.

Next, an explanation will be given of an example of a liquid crystal display panel driving apparatus of MLA method to which the invention is applied in reference to FIG. 1. That is, the liquid crystal display panel driving apparatus of MLA method shown in FIG. 1, includes a simple matrix type liquid crystal display panel 1 of N rows and M columns, a vertical driver 2 for applying row voltage N rows of electrodes of the liquid crystal display panel 1, a horizontal driver 3 for applying column voltage to M columns of electrodes of the liquid crystal display panel 1, a voltage level circuit 4 for supplying the vertical driver 2 and the horizontal driver 3 with voltage at necessary level and drive controlling means 5 for supplying the vertical driver 2 and the horizontal driver 3 with clock pulses.

Figure 1:
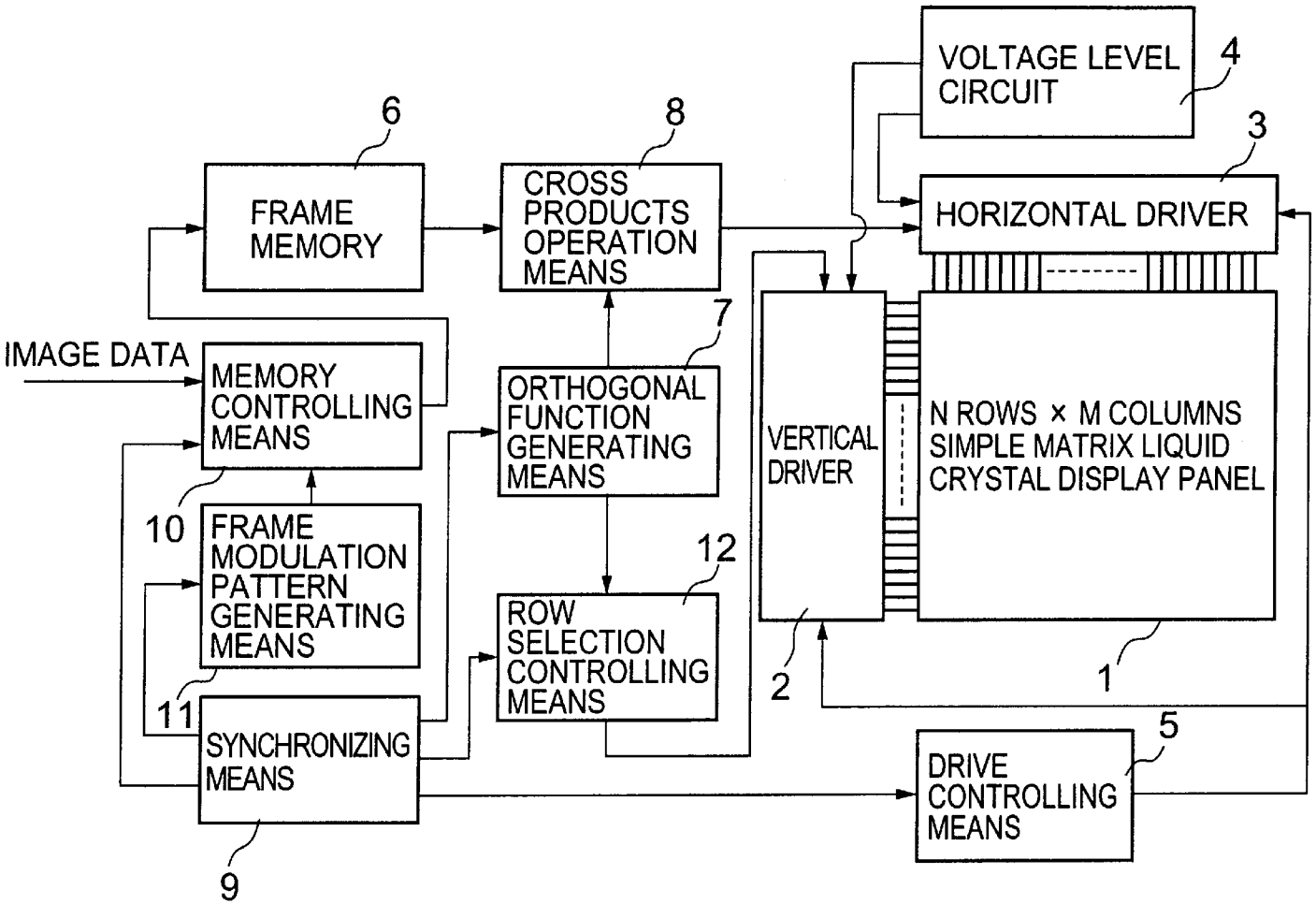
FIG. 1 is a block diagram of a simple matrix type liquid crystal display panel driving apparatus constituted by applying a method of driving a liquid crystal display panel according to the invention.

Further, the liquid crystal display panel driving apparatus of MLA method shown in FIG. 1, includes a frame memory 6 for storing image data bits in units of frames, orthogonal function generating means 7 for generating a plurality of orthogonal functions under orthogonal relationships and providing the orthogonal functions to the vertical driver 2 combined successively in pertinent patterns via row selection controlling means 12, and cross-products operation means 8 for carrying out the cross-products operation on sets of pixel data stored to the frame memory and sets of the orthogonal functions, generating column signals corresponding to the number of digit places in each bit and providing the column signals to the horizontal driver 3. The row selection controlling means 12 is means for controlling the vertical driver 2 to select every other row. Further, an orthogonal function table used in the liquid crystal display panel driving apparatus of 4 MLA method, is as shown by FIG. 3.

Further, the liquid crystal display panel driving apparatus of MLA method shown in FIG. 1 includes frame modulation pattern generating means 11 for generating frame modulation patterns for carrying out gradation display, synchronizing means 9 for synchronizing timings of various operations and memory controlling means 10 formatting image data to be displayed based on the frame modulation patterns from the frame pattern generating means 11 and synchronizing signals from the synchronizing means 9 and storing the image data in the frame memory 6. The frame modulation pattern is as shown by FIG. 2 in the case of 5 gradations.

Further, although not illustrated, a liquid crystal display panel driving apparatus of voltage averaging method or SA method to which the invention is applied, can easily be constituted similar to the liquid crystal display panel driving apparatus of MLA method, mentioned above.

As has been explained above in detail, according to the liquid crystal display panel driving method of the invention adopting the discontinuous selection scanning system, in comparison with liquid crystal display panel driving methods adopting the conventional successive scanning system, although the number of changes in the voltage waveform of the column electrode remains unchanged when the pixels of respective intersections of a certain column with the (2n+1)-th row and the (2n+2)-th row of the multiple gradation frame modulation pattern, are all made ON or all made OFF, the number of changes in the voltage waveform of the column electrode becomes extremely small when one of them is made ON and other is made OFF. The row electrode is selected only once in one frame although voltage is high and so capacity of connected panel is only the amount of the selected electrode. In contrast thereto, in the case of the column electrode, although voltage is small, the voltage waveform of the respective electrode differs according to the display data and so the potential of the whole screen must be changed.

In sum, according to the liquid crystal display panel driving method of the invention adopting the discontinuous selection scanning system, in comparison with the conventional liquid crystal display panel driving method adopting the successive scanning system, the number of changes in the voltage of the column electrode and accordingly, the amount of change in the voltage of the column electrode is reduced and accordingly, power consumption can significantly be reduced. Further, practical display quality is not deteriorated even with the constitution adopting the discontinuous selection scanning system. This is because the invention is based on the fact that according to the screen display of the simple matrix type liquid crystal panel driven by voltage averaging method, SA method or MLA method, gradation is not frequently and significantly changed by background color or display data commonly used.

Further, although the display pattern of the embodiment shows the case of displaying the total screen by the same intermediate gradation level, in the case of displaying other display patterns, scanning is carried out successively from above, the voltage waveform of the column electrode is changed only when the level of gradation is changed and is not changed at with each selection as in the conventional example. Further, the invention is naturally applicable even when there is used a gradation pattern constituted by changing the pattern not one row at a time but rather several rows at a time.

By the method of driving the liquid crystal display panel according to the invention, the amount of change in the waveform between the row electrode and the column electrode can be restrained and power consumption of the simple matrix type liquid crystal panel can be reduced without deteriorating display quality.

What is claimed is:

1. A method of driving a liquid crystal display panel comprising a liquid crystal layer disposed between a row electrode group and a column electrode group defining a plurality of pixels arranged in a matrix, the method comprising the steps of: applying driving signals to the liquid crystal display panel by applying scan signals to the row electrode group and data signals to the column electrode group according to a given driving method; and modulating the driving signals using a frame modulation technique to achieve a multiple gradation display; wherein when, relative to a given column electrode, a voltage level applied to one of the row electrodes is different from a voltage level applied to an adjacent row electrode, an order of scanning the row electrode group is selected discontinuously to minimize a voltage level change in the data signal applied to the given column electrode.

2. A method of driving a liquid crystal display panel according to claim 1; wherein the step of modulating the driving signals using a frame modulation technique is carried out such that when adjacent rows of the row electrode group are alternately turned ON and OFF at an intermediate gradation level thereof, every other row electrode is successively selected.

3. A method of driving a liquid crystal display panel according to claim 1; wherein the step of modulating the driving signals using a frame modulation technique is carried out such that when adjacent pixels are alternately turned ON and OFF in a direction of the column electrodes and in a direction of the row electrodes at an intermediate gradation level thereof, every other pixel is successively selected in the column electrode direction and the row electrode direction.

4. A method of driving a liquid crystal display panel according to claim 1; wherein the given driving method is a voltage averaging method.

5. A method of driving a liquid crystal display panel according to claim 1; wherein the given driving method is a smart addressing (SA) method.

6. A method of driving a liquid crystal display panel according to claim 1; wherein the given driving method is a multiple line addressing (MLA) method.

7. A method of driving a liquid crystal display panel according to claim 1; wherein the given driving method is a voltage averaging method in which a voltage applied to the row electrodes becomes high only once in a single frame and has a constant bias level during a non-selection time period of the frame.

8. A method of driving a liquid crystal display panel according to claim 1; wherein the given driving method is a smart addressing method in which non-selection voltage levels applied to the row electrodes are the same in contiguous frames.

9. A method of driving a liquid crystal display panel according to claim 1; wherein the given driving method is a multiple line addressing method in which driving signals comprising a set of orthogonal functions are simultaneously applied to a plurality of non-adjacent row electrodes of the row electrode group, and driving signals obtained by taking a cross-products operation between the set of orthogonal functions and a set of selected pixel data are applied to plural column electrodes of the column electrode group.

10. A method of driving a liquid crystal display panel according to claim 4; wherein the step of applying driving signals further comprises the steps of dividing the row electrode group into a first group consisting of odd-numbered row electrodes and a second group consisting of even-numbered row electrodes; sequentially selecting row electrodes of the first group; and sequentially selecting row electrodes of the second group.

11. A method of driving a liquid crystal display panel according to claim 5; wherein the step of applying driving signals further comprises the steps of dividing the row electrode group into a first group consisting of odd-numbered row electrodes and a second group consisting of even-numbered row electrodes; sequentially selecting row electrodes of the first group; and sequentially selecting row electrodes of the second group.

12. A method of driving a liquid crystal display panel according to claim 6; wherein the step of applying driving signals further comprises the steps of dividing the row electrode group into a first group consisting of odd-numbered row electrodes and a second group consisting of even-numbered row electrodes; simultaneously selecting row electrodes of the first group; and simultaneously selecting row electrodes of the second group.

13. A method of driving a liquid crystal display panel having row electrodes and column electrodes sandwiching a liquid crystal material, the method comprising the steps of: applying driving signals to the liquid crystal display panel by applying scan signals to the row electrodes and data signals to the column electrodes according to a given driving method such that adjacent row electrodes are not simultaneously selected when a voltage level applied to one of the row electrodes is different from a voltage level applied to an adjacent row electrode, so as to minimize a change in voltage level of the data signal applied to a given column electrode; and modulating the driving signals using a frame modulation technique to produce a multiple gradation display.

14. A method of driving a liquid crystal display panel according to claim 13; wherein the given driving method is a voltage averaging method.

15. A method of driving a liquid crystal display panel according to claim 14; wherein the step of applying driving signals further comprises the steps of dividing the row electrode group into a first group consisting of odd-numbered row electrodes and a second group consisting of even-numbered row electrodes; sequentially selecting row electrodes of the first group; and sequentially selecting row electrodes of the second group.

16. A method of driving a liquid crystal display panel according to claim 13; wherein the given driving method is a smart addressing method.

17. A method of driving a liquid crystal display panel according to claim 16; wherein the step of applying driving signals further comprises the steps of dividing the row electrode group into a first group consisting of odd-numbered row electrodes and a second group consisting of even-numbered row electrodes; sequentially selecting row electrodes of the first group; and sequentially selecting row electrodes of the second group.

18. A method of driving a liquid crystal display panel according to claim 13; wherein the given driving method is a multiple line addressing method.

19. A method of driving a liquid crystal display panel according to claim 18; wherein the step of applying driving signals further comprises the steps of dividing the row electrode group into a first group consisting of odd-numbered row electrodes and a second group consisting of even-numbered row electrodes; simultaneously selecting row electrodes of the first group; and simultaneously selecting row electrodes of the second group.

* * * * *